US010584701B2

(12) United States Patent
Fischer

(10) Patent No.: US 10,584,701 B2
(45) Date of Patent: Mar. 10, 2020

(54) FLUID PUMP WITH ROTATING PUMPING ELEMENT WEAR REDUCTION

(71) Applicant: DELPHI TECHNOLOGIES IP LIMITED, St. Michael (BB)

(72) Inventor: John G. Fischer, Goodrich, MI (US)

(73) Assignee: DELPHI TECHNOLOGIES IP LIMITED (BB)

( * ) Notice: Subject to any disclaimer, the term of this patent is extended or adjusted under 35 U.S.C. 154(b) by 354 days.

(21) Appl. No.: 15/456,849

(22) Filed: Mar. 13, 2017

(65) Prior Publication Data

US 2018/0258929 A1 Sep. 13, 2018

(51) Int. Cl.

| | |
|---|---|
| ***F04C 13/00*** | (2006.01) |
| ***F04C 2/10*** | (2006.01) |
| ***F04C 15/00*** | (2006.01) |
| ***F02M 59/12*** | (2006.01) |
| ***F04C 15/06*** | (2006.01) |
| ***F04C 11/00*** | (2006.01) |
| ***F04C 2/08*** | (2006.01) |

(52) U.S. Cl.

CPC ..... *F04C 13/005* (2013.01); *F02M 59/12* (2013.01); *F04C 2/08* (2013.01); *F04C 2/10* (2013.01); *F04C 2/102* (2013.01); *F04C 11/008* (2013.01); *F04C 13/007* (2013.01); *F04C 15/0003* (2013.01); *F04C 15/008* (2013.01); *F04C 15/06* (2013.01); *F04C 2210/1044* (2013.01); *F04C 2240/30* (2013.01); *F04C 2240/40* (2013.01)

(58) Field of Classification Search

CPC .... F02M 37/048; F02M 37/10; F02M 37/103; F02M 37/106; F02M 37/22; F02M 59/12; F04C 11/008; F04C 13/005; F04C 15/06; F04C 2210/1044; F04C 2/102

USPC ..... 417/410.4

See application file for complete search history.

(56) References Cited

U.S. PATENT DOCUMENTS

| | | | | |
|---|---|---|---|---|
| 5,718,208 | A * | 2/1998 | Brautigan | F02M 37/048 123/509 |
| 6,402,460 | B1 | 6/2002 | Fischer et al. | |
| 6,435,810 | B1 | 8/2002 | Fischer et al. | |
| 6,623,237 | B2 | 9/2003 | Harris et al. | |
| 6,769,889 | B1 | 8/2004 | Raney et al. | |
| 2003/0039539 | A1 * | 2/2003 | Harris | F04D 5/002 415/55.1 |
| 2004/0037726 | A1 | 2/2004 | Burhenne et al. | |
| 2006/0140790 | A1 | 6/2006 | Muehlhausen et al. | |

(Continued)

*Primary Examiner* — Dominick L Plakkoottam

(74) *Attorney, Agent, or Firm* — Joshua M. Haines

(57) ABSTRACT

A fluid pump includes an inlet plate with an inlet; an outlet plate, the outlet plate having an outlet plate outlet passage; an outlet; an electric motor having a shaft which rotates; a pumping element coupled to the shaft such that rotation of the pumping element by the shaft causes fluid to be pumped from the inlet to the outlet, the inlet plate interfacing with the pumping element in an inlet sealing surface interface and the outlet plate interfacing with the pumping element in an outlet sealing surface interface; a purge passage which receives fluid from the outlet plate outlet passage, the purge passage being in fluid communication with the inlet sealing surface interface and the outlet sealing surface interface; and a filter downstream of the outlet plate outlet passage which filters fluid that passes through the purge passage prior to reaching the inlet and outlet sealing surface interfaces.

10 Claims, 4 Drawing Sheets

(56) References Cited

U.S. PATENT DOCUMENTS

| | | | | |
|---|---|---|---|---|
| 2012/0224991 | A1* | 9/2012 | Lipinski | F04C 2/084<br>418/166 |
| 2014/0314591 | A1 | 10/2014 | Herrera et al. | |
| 2018/0087504 | A1 | 3/2018 | Sakai et al. | |

* cited by examiner

FLUID PUMP WITH ROTATING PUMPING ELEMENT WEAR REDUCTION

TECHNICAL FIELD OF INVENTION

The present invention relates to a fluid pump which pumps fluid; more particularly to a fluid pump with a rotating pumping element disposed axially between two plates, and still even more particularly to such a fluid pump which includes a purge passage and filter to minimize or eliminate contamination which can infiltrate into the axial clearances between the pumping element and plates.

BACKGROUND OF INVENTION

Fluid pumps, and more particularly fuel pumps for pumping fuel, for example, from a fuel tank of a motor vehicle to an internal combustion engine of the motor vehicle, are known. A typical fuel pump includes a housing within which generally includes a pump section, a motor section, and an outlet section. The pump section includes a rotating pumping element, either positive displacement or centrifugal, located axially between an inlet plate and an outlet plate. The pumping element imparts energy into the fuel while forcing the fuel to move from a low pressure state to a high pressure state. An axial clearance is provided between the pumping element and the inlet plate and between the pumping element and the outlet plate such that each axial clearance is large enough to allow the pumping element to rotate freely while being small enough to prevent high pressure fuel from leaking into areas of low pressure. If the axial clearances are excessive, leakage may occur, which results in low flow output of the fuel pump. For perspective, each axial clearance may typically be about 10 to 15 μm for a total of about 20 to 30 μm. The fuel pump typically includes a pre-filter or strainer which is attached to an inlet of the fuel pump in order to strain out large debris from the fuel before the fuel enters the fuel pump. The pre-filter is sized to balance its ability to strain harmful contaminants without creating a flow restriction that can cause cavitation at the inlet of the fuel pump. Consequently, the pre-filter is normally constrained by cavitation considerations in gasoline arrangements or by fuel waxing considerations in diesel fuel arrangements and therefore is not fine enough to strain out all harmful contaminants. As a result, a percentage of the contaminants that enter the fuel pump infiltrate the axial clearances between the pumping element and the inlet plate and between the pumping element and the outlet plate. Infiltration of contaminants into the axial clearances is promoted by pressure gradients which exist between the inlet and radially inner and radially outer portions of the pumping element and by pressure gradients which exist between the outlet and radially inner and radially outer portions of the pumping element since the pressurized fuel that is forced into the axial clearances contains contaminants that passed through the pre-filter. Rotation of the pumping element, together with the presence of contaminants in the axial clearances, results in abrasion which results in wear of the surfaces of the pumping element, inlet plate, and outlet plate, thereby decreasing the flow output of the fuel pump over time due to ever-increasing axial clearances. One example of such a fuel pump is a gerotor-type fuel pump as shown in U.S. Pat. No. 6,769,889 to Raney et al., the disclosure of which is incorporated herein by reference in its entirety. Another example of such a fuel pump is an impeller type fuel pump as shown in United States Patent Application Publication No. 2014/0314591 A1 to Herrara et al., the disclosure of which is incorporated herein by reference in its entirety.

What is needed is a fuel pump which minimizes or eliminates one or more of the shortcomings as set forth above.

SUMMARY OF THE INVENTION

Briefly described, a fluid pump includes a housing; an inlet plate disposed within the housing, the inlet plate having an inlet which introduces fluid to the housing; an outlet plate disposed within the housing, the outlet plate having an outlet plate outlet passage; an electric motor having a shaft which rotates about an axis; an outlet which discharges fluid from the housing; a pumping element rotationally coupled to the shaft such that rotation of the pumping element by the shaft causes fluid to be pumped from the inlet to the outlet plate outlet passage and through the outlet, the pumping element being located axially between the inlet plate and the outlet plate such that the inlet plate interfaces with the pumping element in an inlet sealing surface interface and such that the outlet plate interfaces with the pumping element in an outlet sealing surface interface; a purge passage downstream of the outlet plate outlet passage which receives fluid from the outlet plate outlet passage, the purge passage being in fluid communication with the inlet sealing surface interface and with the outlet sealing surface interface; and a filter downstream of the outlet plate outlet passage which filters fluid that passes through the purge passage prior to reaching the inlet sealing surface interface and the outlet sealing surface interface. The purge passage and the filter minimize or eliminate contamination at the inlet sealing surface interface and the outlet sealing surface interface, thereby minimizing wear and extending the service life of the fluid pump.

BRIEF DESCRIPTION OF DRAWINGS

This invention will be further described with reference to the accompanying drawings in which.

DETAILED DESCRIPTION OF INVENTION

Figure 1:
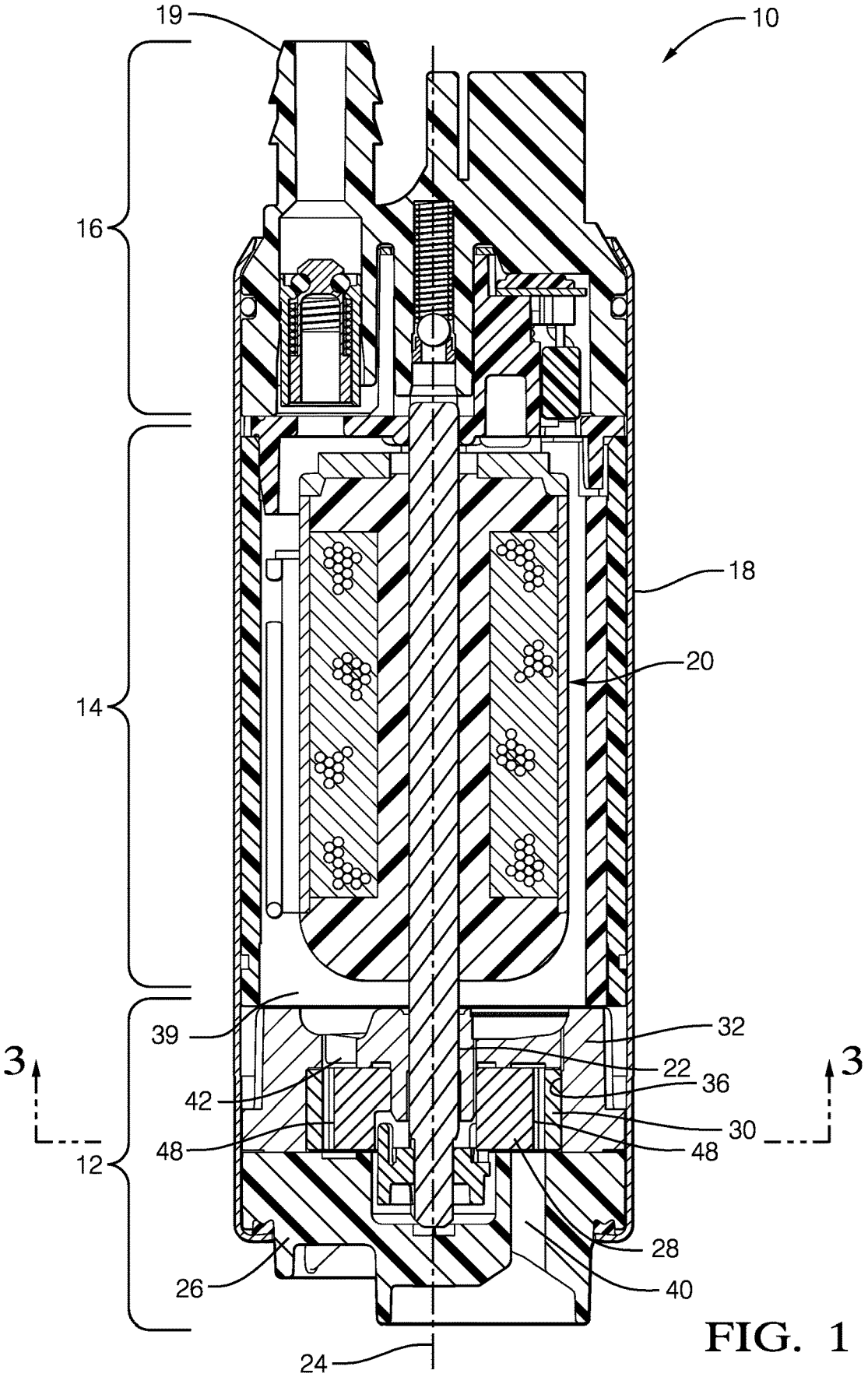
FIG. 1 is an axial cross-sectional view of a fluid pump in accordance with the present invention.
Figure 2:
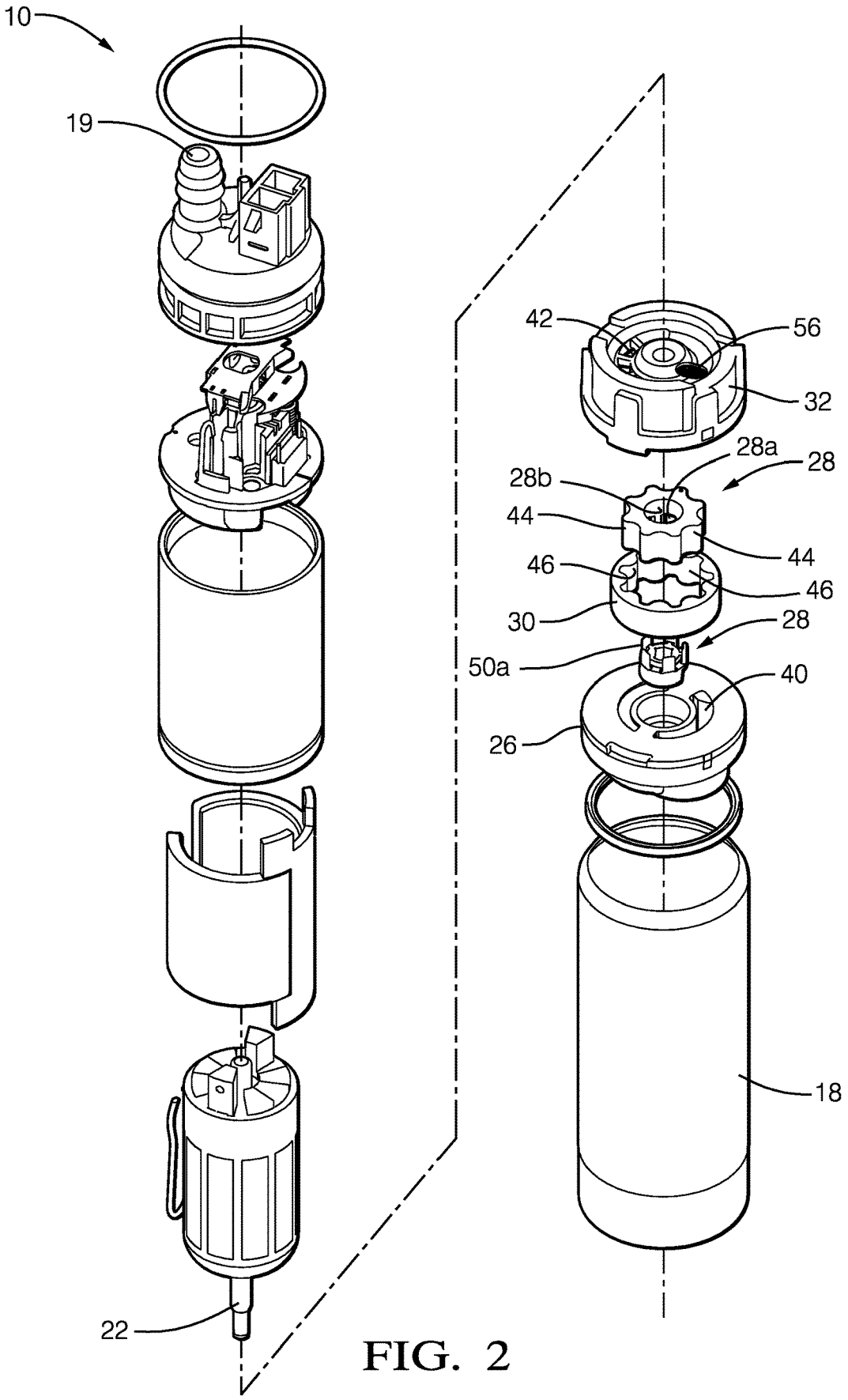
FIG. 2 is an exploded isometric view of the fluid pump of FIG. 1.

Reference will first be made to FIGS. 1 and 2 which are an axial cross-sectional view and an exploded isometric view respectively of a fluid pump illustrated as a fuel pump 10 for pumping liquid fuel, by way of non-limiting example only gasoline or diesel fuel, from a fuel tank (not shown) to an internal combustion engine (not shown). While the fluid pump is illustrated as fuel pump 10, it should be understood that the invention is not to be limited to a fuel pump, but could also be applied to fluid pumps for pumping fluids other than fuel. Fuel pump 10 generally includes a pump section 12 at one end, a motor section 14 adjacent to pump section 12, and an outlet section 16 adjacent to motor section 14 at the end of fuel pump 10 opposite pump section 12. A housing 18 of fuel pump 10 retains pump section 12, motor section 14 and outlet section 16 together. Fuel enters fuel pump 10 at pump section 12, a portion of which is rotated by motor section 14 as will be described in more detail later, and is pumped past motor section 14 to outlet section 16 where the fuel exits fuel pump 10 through an outlet 19 of outlet section 16.

Motor section 14 includes an electric motor 20 which is disposed within housing 18. Electric motor 20 includes a shaft 22 extending therefrom into pump section 12. Shaft 22 rotates about a first axis 24 when an electric current is applied to electric motor 20. Electric motors and their operation are well known, consequently, electric motor 20 will not be discussed further herein. Electric motor 20 may be configured as shown in United State Patent Application Publication No. US 2014/0314591 A1 to Herrera et al., the disclosure of which is incorporated herein by reference in its entirety.

Figure 3:
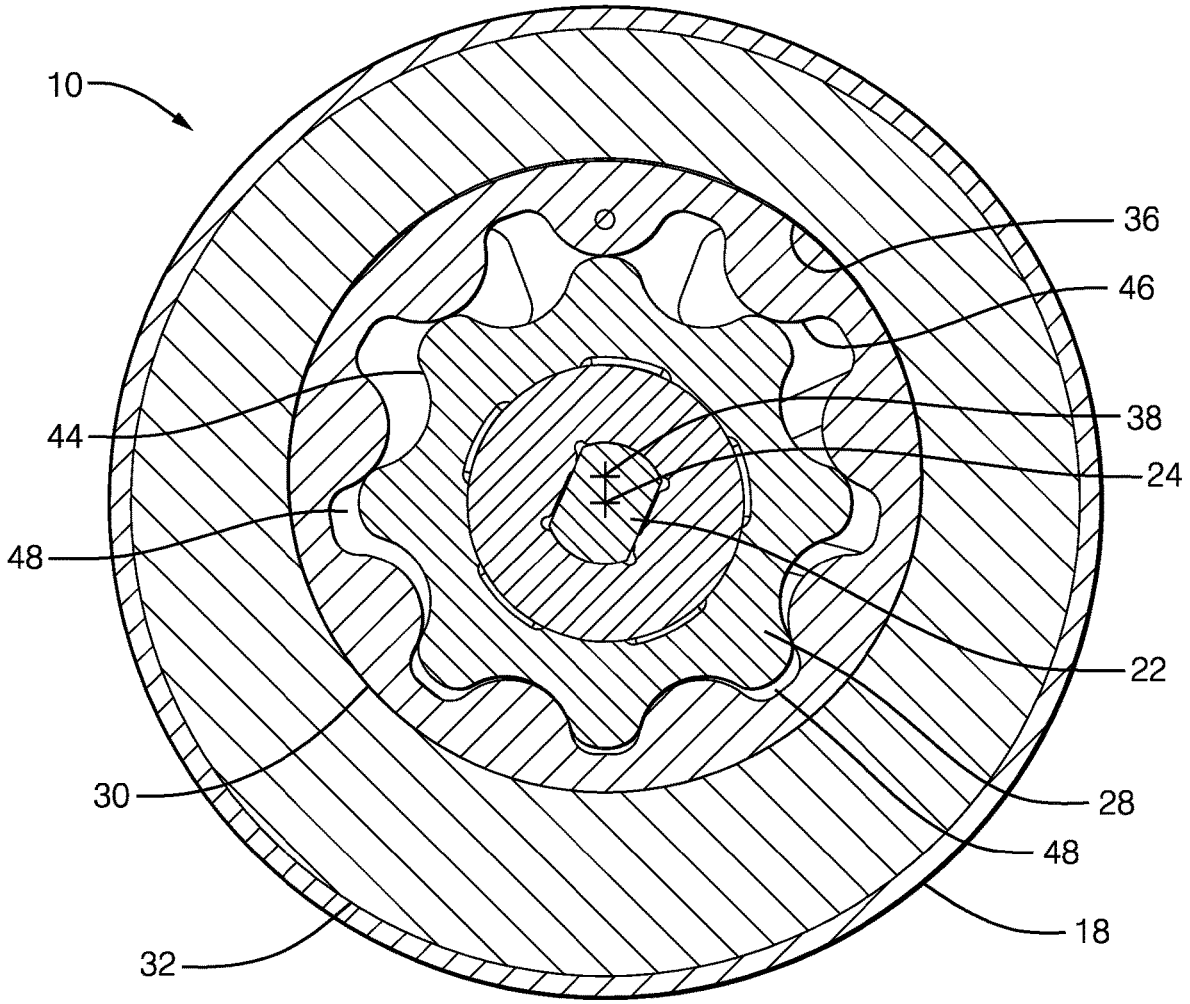
FIG. 3 is a radial cross-sectional view of the fluid pump of FIG. 1 taken through an inner gear rotor and an outer gear rotor of the fluid pump.
Figure 4:
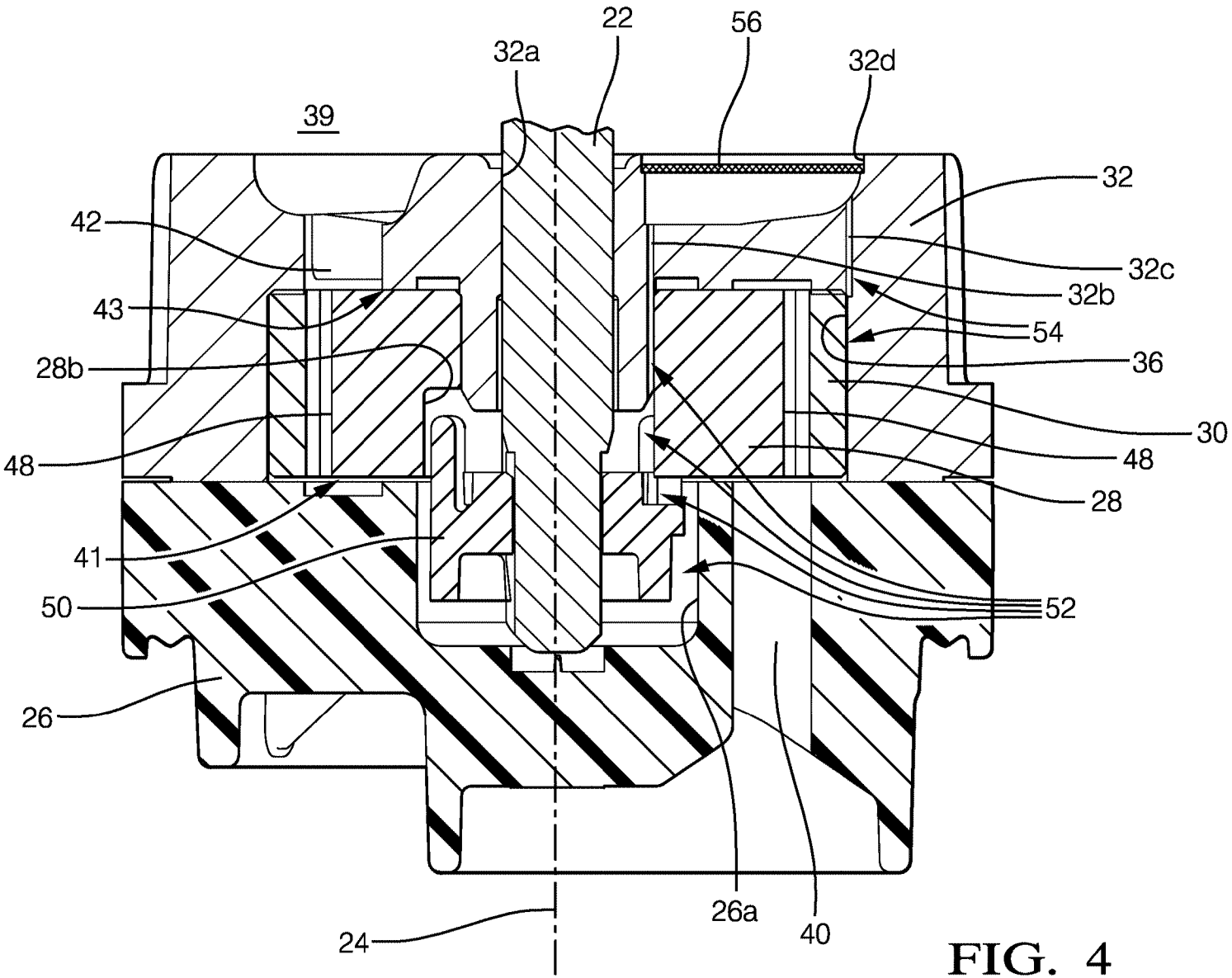
FIG. 4 is an enlarged portion of the axial cross-sectional view of FIG. 1, shown with a housing of the fluid pump omitted for clarity.

With continued reference to FIGS. 1 and 2 and now with additional reference to FIGS. 3 and 4, pump section 12 includes an inlet plate 26, a pumping element illustrated as an inner gear rotor 28 and an outer gear rotor 30, and an outlet plate 32. Collectively, inner gear rotor 28 and outer gear rotor 30 will be referred to herein as pumping element 28, 30. Inlet plate 26 is disposed at the end of pump section 12 that is distal from motor section 14 while outlet plate 32 is disposed at the end of pump section 12 that is proximal to motor section 14. Pumping element 28, 30 is rotatably disposed within a gear rotor bore 36 which extends into outlet plate 32 from the face of outlet plate 32 that abuts inlet plate 26. Gear rotor bore 36 is centered about a second axis 38 (best shown in FIG. 3) which is parallel and laterally offset relative to first axis 24. In this way, pumping element 28, 30 is located axially between inlet plate 26 and outlet plate 32 such that inlet plate 26 interfaces with pumping element 28, 30 in an inlet sealing surface interface 41 and such that outlet plate 32 interfaces with pumping element 28, 30 in an outlet sealing surface interface 43. Gear rotor bore 36 is diametrically sized to allow outer gear rotor 30 to rotate freely therein while substantially preventing radial movement of outer gear rotor 30. Gear rotor bore 36 is axially sized, i.e. in the direction of second axis 38, to be slightly larger than the thickness of pumping element 28, 30 in order to allow inner gear rotor 28 and outer gear rotor 30 to rotate freely therein while keeping the clearance at inlet sealing surface interface 41 and outlet sealing surface interface 43 sufficiently small to allow the fluid to be pressurized by rotation of pumping element 28, 30. By way of non-limiting example only, the axial clearance at each of inlet sealing surface interface 41 and outlet sealing surface interface 43 may be 10 μm, for a total of 20 μm axial clearance provided for pumping element 28, 30 within gear rotor bore 36. Inlet plate 26 includes an inlet 40 which extends therethrough to provide fluid communication from the outside of fuel pump 10 to gear rotor bore 36 while outlet plate 32 includes an outlet plate outlet passage 42 which extends therethrough to provide fluid communication from gear rotor bore 36 to outlet section 16.

Inner gear rotor 28 includes a plurality of external teeth 44 on the outer perimeter thereof which engage complementary internal tooth recesses 46 of outer gear rotor 30, thereby defining a plurality of variable volume pumping chambers 48 between inner gear rotor 28 and outer gear rotor 30. It should be noted that only representative external teeth 44, internal tooth recesses 46 and pumping chambers 48 have been labeled in the drawings. As shown, inner gear rotor 28 has eight external teeth 44 while outer gear rotor 30 has nine internal tooth recesses 46, however, it should be understood that inner gear rotor 28 may have any number n external teeth 44 while outer gear rotor 30 has n+1 internal tooth recesses 46. Inlet 40 of inlet plate 26 is aligned with a portion of gear rotor bore 36 within which the geometry between external teeth 44 and internal tooth recesses 46 create pumping chambers 48 of relative large size while outlet plate outlet passage 42 of outlet plate 32 is aligned with a portion of gear rotor bore 36 within which the geometry between external teeth 44 and internal tooth recesses 46 create pumping chambers 48 of relatively small size. Shaft 22 extends through an outlet plate bore 32*a* of outlet plate 32 such that outlet plate bore 32*a* and shaft 22 form a bearing interface which allows shaft 22 to rotate freely about first axis 24 while preventing movement of shaft 22 in a lateral direction relative to first axis 24. Inner gear rotor 28 is rotationally coupled to shaft 22 through a coupling 50, located partially within a recess 26*a* of inlet plate 26 which extends axially into inlet plate 26, having external fingers 50*a* which engage complementary internal slots 28*a* formed around an inner periphery 28*b* of inner gear rotor 28, and consequently, when electric motor 20 is rotated by application of an electric current, inner gear rotor 28 rotates about first axis 24. By virtue of external teeth 44 engaging internal tooth recesses 46, rotation of inner gear rotor 28 causes outer gear rotor 30 to rotate about second axis 38. In this way, the volume of pumping chambers 48 decrease as each pumping chamber 48 rotates from being in communication with inlet 40 to being in communication with outlet plate outlet passage 42, thereby causing fuel to be pressurized and pumped from inlet 40 to outlet plate outlet passage 42 to a high pressure chamber 39 located downstream of outlet plate outlet passage 42 within housing 18. The fuel is then communicated past electric motor 20 to outlet 19.

In order minimize contamination that is communicated to inlet sealing surface interface 41 and to outlet sealing surface interface 43, fuel pump 10 includes an inner purge passage 52, an outer purge passage 54, and a filter 56. Inner purge passage 52, outer purge passage 54 and filter 56 provide clean fuel to inlet sealing surface interface 41 and to outlet sealing surface interface 43 at a pressure which promotes infiltration of the clean fuel to inlet sealing surface interface 41 and outlet sealing surface interface 43 while deterring infiltration of contaminate carrying fuel to inlet sealing surface interface 41 and outlet sealing surface interface 43 which would could otherwise accelerate wear between pumping element 28, 30 and between inlet plate 26 and between pumping element 28, 30 and outlet plate 32.

Inner purge passage 52 provides a fluid path in which clean fuel is supplied to inlet sealing surface interface 41 and to outlet sealing surface interface 43 in a direction radially outward relative to first axis 24. Inner purge passage 52 is defined in part through an outlet plate inner purge passage 32*b* which extends axially through outlet plate 32 from high pressure chamber 39 to inner periphery 28*b* of inner gear rotor 28. The interface of internal slots 28*a* and external fingers 50*a* allows fluid communication from inner periphery 28*b* to recess 26*a*, and consequently, internal slots 28*a* and recess 26*a* define the remainder of inner purge passage 52. As can be seen most clearly in FIGS. 1 and 4, inner purge passage 52 passes across inlet sealing surface interface 41 and outlet sealing surface interface 43, thereby providing fuel to inlet sealing surface interface 41 and outlet sealing surface interface 43 in a direction radially outward relative to first axis 24.

Outer purge passage 54 provides a fluid path in which clean fuel is supplied to inlet sealing surface interface 41 and to outlet sealing surface interface 43 in a direction radially inward relative to first axis 24. Outer purge passage 54 is defined in part through an outlet plate outer purge passage 32*c* which extends axially through outlet plate 32 from high pressure chamber 39 to the outer periphery of pumping element 28, 30, and consequently, the clearance between outlet plate bore 32*a* and outer gear rotor 30 defines the remainder of outer purge passage 54. As can be seen most clearly in FIGS. 1 and 4, outer purge passage 54 passes across inlet sealing surface interface 41 and outlet sealing surface interface 43, thereby providing fuel to inlet sealing surface interface 41 and outlet sealing surface interface 43 in a direction radially inward toward first axis 24.

Filter 56 ensures that fuel that is communicated to inlet sealing surface interface 41 and outlet sealing surface interface 43 is reduced or free of contaminants that are harmful to inlet sealing surface interface 41 and outlet sealing surface interface 43. By way of non-limiting example only filter 56, may be selected to prevent contaminants larger than approximately 5-12 μm from passing therethrough. Filter 56 can be any material known for preventing contaminants of the chosen size from passing therethrough, and may be, by way of non-limiting example only, filter paper, woven mesh, or etched metal. Filter 56 is fixed to outlet plate 32 in an outlet plate recess 32*d* formed therein and may be fixed therein, by way of non-limiting example, by adhesives, overmolding, or welding. Filter 56 is located downstream of outlet plate outlet passage 42 within high pressure chamber 39 and upstream of both inner purge passage 52 and outer purge passage 54. In this way, fuel that is supplied to inlet sealing surface interface 41 and outlet sealing surface interface 43 by inner purge passage 52 and outer purge passage 54 is minimized or free of contaminants that are harmful to inlet sealing surface interface 41 and outlet sealing surface interface 43. Alternatively, filter 56 may be oriented such that fuel flowing to outlet 19 continually passes over filter 56, thereby keeping filter 56 free of contaminants by carrying the contaminants to outlet 19.

In operation, electricity is applied electric motor 20 which causes pumping element 28, 30 to rotate, thereby drawing fuel in through inlet 40 to pumping chambers 48 at an initial pressure $P_I$, which may be by way of non-limiting example only, 0 kPa. Rotation of pumping element 28, 30 further causes the volume of pumping chambers 48 to decrease as each pumping chamber 48 rotates from being in communication with inlet 40 to being in communication with outlet plate outlet passage 42, thereby causing fuel to be pressurized to a final pressure $P_F$, which may be by way of non-limiting example only, on the order of 400 kPa, and pumped from inlet 40 to outlet plate outlet passage 42 to high pressure chamber 39 located downstream of outlet plate outlet passage 42 within housing 18. The majority of the fuel is communicated past electric motor 20 to outlet 19, however, a small portion of fuel passes through filter 56 where contaminants are captured and the clean, pressurized fuel is communicated through inner purge passage 52 and outer purge passage 54. Consequently, unlike the prior art, the pressure within the pumping chamber 48 which is in fluid communication with outlet plate outlet passage 42 is substantially the same as the pressure ($P_F$) at inlet sealing surface interface 41 and outlet sealing surface interface 43 locations that are radially inward (within inner periphery 28*b*) and radially outward (the outer periphery of pumping element 28, 30) therefrom. As such, a pressure differential does not exist which would tend to cause the unfiltered fuel to infiltrate inlet sealing surface interface 41 and outlet sealing surface interface 43 from the pumping chamber 48 which is in fluid communication with outlet plate outlet passage 42. As used herein, substantially the same relative to pressure $P_F$ includes a pressure drop of up to 10%. Also consequently, unlike the prior art, the fuel at inlet sealing surface interface 41 and outlet sealing surface interface 43 locations that are radially inward (within inner periphery 28*b*) and radially outward (the outer periphery of pumping element 28, 30) from the pumping chamber 48 which is in fluid communication with inlet 40 is substantially the same as the pressure ($P_F$) as in high pressure chamber 39. As such, the pressure differential ($P_F$–$P_I$) which promotes leakage across inlet sealing surface interface 41 and outlet sealing surface interface 43 to the pumping chamber 48 which is in fluid communication with inlet 40 causes clean fuel that is minimized or free of wear causing contaminants to pass across inlet sealing surface interface 41 and outlet sealing surface interface 43. In this way, contamination at inlet sealing surface interface 41 and outlet sealing surface interface 43 is minimized or eliminated, thereby reducing wear and extending the service life of fuel pump 10.

While fuel pump 10 has been described as including both inner purge passage 52 and outer purge passage 54, it should now be understood that one of inner purge passage 52 and outer purge passage 54 may be omitted while gaining the benefit of the remaining inner purge passage 52 or outer purge passage 54. Furthermore, while filter 56 has been illustrated as filtering fuel that is supplied to both inner purge passage 52 and outer purge passage 54, it should now be understood that inner purge passage 52 and outer purge passage 54 may each have their own distinct filter. As such, filter 56 as used herein encompasses inner purge passage 52 and outer purge passage 54 having their own distinct filter.

As described herein, the pumping element 28, 30 has been illustrated as inner gear rotor 28 and outer gear rotor 30. However, it should now be understood that the pumping arrangement may take other forms which may include, by way of non-limiting example only, an impeller as illustrated in United States Patent Application Publication No. 2014/0314591 to Herrara et al.

While this invention has been described in terms of preferred embodiments thereof, it is not intended to be so limited, but rather only to the extent set forth in the claims that follow.

I claim:

1. A fluid pump comprising:

a housing;

an inlet plate disposed within said housing, said inlet plate having an inlet which introduces fluid to said housing;

an outlet plate disposed within said housing, said outlet plate having an outlet plate outlet passage;

an outlet which discharges fluid from said housing;

an electric motor having a shaft which rotates about an axis;

a pumping element rotationally coupled to said shaft such that rotation of said pumping element by said shaft causes fluid to be pumped from said inlet to said outlet plate outlet passage and through said outlet, said pumping element being located axially between said inlet plate and said outlet plate such that said inlet plate interfaces with said pumping element in an inlet sealing surface interface and such that said outlet plate interfaces with said pumping element in an outlet sealing surface interface;

a purge passage downstream of said outlet plate outlet passage, when said pumping element is rotated to cause fluid to be pumped from said inlet to said outlet plate outlet passage, which receives fluid from said outlet plate outlet passage, said purge passage being in fluid communication with said inlet sealing surface interface and with said outlet sealing surface interface; and a filter downstream of said outlet plate outlet passage, when said pumping element is rotated to cause fluid to be pumped from said inlet to said outlet plate outlet passage, which filters fluid that passes through said purge passage prior to reaching said inlet sealing surface interface and said outlet sealing surface interface.

2. A fluid pump as in claim 1, wherein said purge passage passes through said outlet plate.

3. A fluid pump as in claim 2, wherein said purge passage passes through said outlet plate to an inner periphery of said pumping element which surrounds said axis.

4. A fluid pump as in claim 3, wherein said purge passage is an inner purge passage, said fluid pump further comprising an outer purge passage downstream of said outlet plate outlet passage, when said pumping element is rotated to cause fluid to be pumped from said inlet to said outlet plate outlet passage, which receives fluid from said outlet plate outlet passage, said outer purge passage being in fluid communication with said inlet sealing surface interface and with said outlet sealing surface interface such that said filter filters fluid that passes through said purge passage prior to reaching said inlet sealing surface interface and said outlet sealing surface interface, wherein said outer purge passage passes through said outlet plate to an outer periphery of said pumping element which surrounds said axis.

5. A fluid pump as in claim 2, wherein said purge passage passes through said outlet plate to an outer periphery of said pumping element which surrounds said axis.

6. A fluid pump as in claim 1, wherein said pumping element includes an inner periphery extending therethrough which defines in part said purge passage.

7. A fluid pump as in claim 6 wherein said purge passage is an inner purge passage, said fluid pump further comprising an outer purge passage downstream of said outlet plate outlet passage, when said pumping element is rotated to cause fluid to be pumped from said inlet to said outlet plate outlet passage, which receives fluid from said outlet plate outlet passage, said outer purge passage being in fluid communication with said inlet sealing surface interface and with said outlet sealing surface interface such that said filter filters fluid that passes through said purge passage prior to reaching said inlet sealing surface interface and said outlet sealing surface interface at an outer periphery of said pumping element which surrounds said axis.

8. A fluid pump as in claim 1, wherein said filter is fixed to a recess within said outlet plate.

9. A fluid pump as in claim 1, wherein said purge passage is in fluid communication with said inlet sealing surface interface and with said outlet sealing surface interface at a pressure that is substantially equal to a pressure at said outlet plate outlet passage.

10. A fluid pump as in claim 1, wherein said purge passage receives fluid from said outlet plate outlet passage after entering said fluid pump through said inlet and before passing through said outlet.

* * * * *